US011210902B2

(12) United States Patent
Olive

(10) Patent No.: US 11,210,902 B2
(45) Date of Patent: Dec. 28, 2021

(54) SYSTEM AND METHOD FOR PROVIDING A FEATURE GAME

(71) Applicant: Aristocrat Technologies Australia Pty Limited, North Ryde (AU)

(72) Inventor: Scott Christopher Olive, Narrabeen (AU)

(73) Assignee: ARISTOCRAT TECHNOLOGIES AUSTRALIA PTY LIMITED

( * ) Notice: Subject to any disclaimer, the term of this patent is extended or adjusted under 35 U.S.C. 154(b) by 108 days.

(21) Appl. No.: 16/703,573

(22) Filed: Dec. 4, 2019

(65) Prior Publication Data

US 2020/0105101 A1 Apr. 2, 2020

Related U.S. Application Data

(63) Continuation of application No. 16/455,166, filed on Jun. 27, 2019, which is a continuation of application (Continued)

(30) Foreign Application Priority Data

Aug. 11, 2014 (AU) ..... 2014903132

(51) Int. Cl.
*G07F 17/32* (2006.01)
*G07F 17/34* (2006.01)

(52) U.S. Cl.
CPC ..... *G07F 17/3258* (2013.01); *G07F 17/326* (2013.01); *G07F 17/3209* (2013.01);

(Continued)

(58) Field of Classification Search
CPC .. G07F 17/3255; G07F 17/34; G07F 17/3267; G07F 17/3262; G07F 17/326;

(Continued)

(56) References Cited

U.S. PATENT DOCUMENTS 6,251,013 B1 6/2001 Bennett
7,070,501 B2 7/2006 Cormack (Continued)

FOREIGN PATENT DOCUMENTS

AU 2013202658 1/2014
AU 2013251288 5/2014

(Continued)

OTHER PUBLICATIONS

Office Action dated Jun. 25, 2020 for U.S. Appl. No. 16/537,223 (pp. 1-11).

(Continued)

*Primary Examiner* — Reginald A Renwick
(74) *Attorney, Agent, or Firm* — McAndrews, Held & Malloy, Ltd.

(57) ABSTRACT

A gaming machine includes a game controller that initiates play of a base game in response to a first input received via a player interface. The game controller spins base game virtual reels to select and display a first symbols at display positions on a display device. The game controller, in response determining that a quantity of configurable symbols in the first symbols has a predetermined relationship to a predetermined quantity, triggers display of a feature game. The game controller further sets a quantity of remaining games for the feature game to an initial quantity. For each remaining game of the feature game, the game controller spins one or more feature game virtual reels to select and display symbols for one or more of the display positions with non-configurable symbols while holding configurable symbols at their respective display positions.

20 Claims, 10 Drawing Sheets

Related U.S. Application Data

No. 15/986,192, filed on May 22, 2018, now Pat. No. 10,339,761, which is a continuation of application No. 14/823,536, filed on Aug. 11, 2015, now abandoned.

(52) U.S. Cl.
CPC ..... *G07F 17/3213* (2013.01); *G07F 17/3225* (2013.01); *G07F 17/3244* (2013.01); *G07F 17/3262* (2013.01); *G07F 17/3267* (2013.01); *G07F 17/34* (2013.01); *G07F 17/3255* (2013.01)

(58) Field of Classification Search
CPC ..... G07F 17/3244; G07F 17/3225; G07F 17/3213; G07F 17/3209; G07F 17/3258
See application file for complete search history.

(56) References Cited

U.S. PATENT DOCUMENTS

| | | | | |
|---|---|---|---|---|
| 7,252,589 | B1 * | 8/2007 | Marks | G07F 17/3265 463/16 |
| 7,473,173 | B2 * | 1/2009 | Peterson | G07F 17/3211 273/138.1 |
| 7,591,724 | B2 | 9/2009 | Baerlocher | |
| 7,722,457 | B1 | 5/2010 | Marks | |
| 7,789,750 | B2 | 9/2010 | Marks | |
| D624,927 | S | 10/2010 | Allen | |
| 7,850,520 | B2 * | 12/2010 | Yoshimi | G07F 17/34 463/20 |
| 7,878,903 | B2 * | 2/2011 | Chan | G07F 17/3211 463/31 |
| D648,347 | S | 11/2011 | Chaudhri | |
| 8,216,051 | B2 | 7/2012 | Rasmussen | |
| 8,360,851 | B2 | 1/2013 | Aoki et al. | |
| 8,747,205 | B2 * | 6/2014 | Englman | G07F 17/32 463/16 |
| 8,784,191 | B1 | 7/2014 | Basallo | |
| 9,235,965 | B2 | 1/2016 | Tuck | |
| 9,424,720 | B2 | 8/2016 | Suda | |
| 9,646,458 | B2 * | 5/2017 | Zielinski | G07F 17/3227 |
| 9,767,650 | B2 | 9/2017 | Jaffe | |
| 9,928,691 | B2 | 3/2018 | Olive | |
| D824,932 | S | 8/2018 | Joensson | |
| D834,596 | S | 11/2018 | Bae | |
| 10,720,022 | B2 | 7/2020 | Caputo | |
| 2003/0060272 | A1 * | 3/2003 | Glavich | G07F 17/3244 463/25 |
| 2003/0130027 | A1 * | 7/2003 | Aida | G07F 17/3265 463/20 |
| 2003/0216165 | A1 | 11/2003 | Singer et al. | |
| 2004/0048646 | A1 | 3/2004 | Visocnik | |
| 2004/0053680 | A1 * | 3/2004 | Schultz | G07F 17/32 463/20 |
| 2004/0137982 | A1 | 7/2004 | Cuddy et al. | |
| 2004/0266508 | A1 * | 12/2004 | D'Avanzo | G07F 17/32 463/16 |
| 2005/0043082 | A1 | 2/2005 | Peterson | |
| 2006/0084498 | A1 * | 4/2006 | Baerlocher | G07F 17/3213 463/20 |
| 2006/0189369 | A1 | 8/2006 | Taylor | |
| 2007/0060248 | A1 | 3/2007 | Rodgers et al. | |
| 2007/0129135 | A1 | 6/2007 | Marks et al. | |
| 2007/0178965 | A1 * | 8/2007 | Inoue | G07F 17/3211 463/30 |
| 2008/0032773 | A1 * | 2/2008 | Okada | G07F 17/3258 463/20 |
| 2008/0039191 | A1 | 2/2008 | Cuddy | |
| 2008/0182650 | A1 | 7/2008 | Randall | |
| 2009/0054129 | A1 | 2/2009 | Koshimura et al. | |
| 2009/0124326 | A1 | 5/2009 | Caputo | |
| 2009/0131145 | A1 | 5/2009 | Aoki | |
| 2009/0239631 | A1 | 9/2009 | Aoki | |
| 2009/0239634 | A1 | 9/2009 | Nguyen | |
| 2010/0022294 | A1 * | 1/2010 | Yoshizawa | G07F 17/34 463/20 |
| 2010/0029364 | A1 | 2/2010 | Zielinski | |
| 2010/0075737 | A1 | 3/2010 | Bluemel | |
| 2010/0093422 | A1 | 4/2010 | Gomez | |
| 2010/0130281 | A1 | 5/2010 | Little | |
| 2010/0210343 | A1 | 8/2010 | Englman | |
| 2010/0234092 | A1 | 9/2010 | Gomez et al. | |
| 2010/0281107 | A1 | 11/2010 | Fallows | |
| 2011/0157196 | A1 | 6/2011 | Nave | |
| 2011/0165934 | A1 * | 7/2011 | Marks | G07F 17/3209 463/20 |
| 2012/0015707 | A1 | 1/2012 | Hornik | |
| 2012/0094738 | A1 | 4/2012 | Aoki | |
| 2012/0178517 | A1 | 7/2012 | Montenegro et al. | |
| 2013/0225258 | A1 | 8/2013 | Caputo | |
| 2013/0303265 | A1 | 11/2013 | Wilkins | |
| 2013/0331168 | A1 | 12/2013 | Street | |
| 2014/0080564 | A1 | 3/2014 | Acres | |
| 2014/0080570 | A1 * | 3/2014 | Watkins | G07F 17/3267 463/20 |
| 2014/0274292 | A1 | 9/2014 | Suda | |
| 2014/0309013 | A1 | 10/2014 | Meyer | |
| 2014/0323198 | A1 | 10/2014 | Tuck | |
| 2015/0310699 | A1 | 10/2015 | Meyer | |
| 2015/0332544 | A1 | 11/2015 | Kitamura | |
| 2016/0042597 | A1 | 2/2016 | Olive | |
| 2016/0253873 | A1 | 9/2016 | Olive | |
| 2016/0364944 | A1 * | 12/2016 | Elias | G07F 17/3225 |
| 2017/0032609 | A1 | 2/2017 | Inamura | |
| 2017/0061743 | A1 * | 3/2017 | Itagaki | G07F 17/3213 |
| 2017/0148274 | A1 | 5/2017 | Olive | |
| 2017/0154498 | A1 * | 6/2017 | Olive | G07F 17/3262 |
| 2018/0001216 | A1 | 1/2018 | Bruzzo | |
| 2018/0075708 | A1 | 3/2018 | San | |
| 2018/0268655 | A1 | 9/2018 | Olive | |
| 2019/0051097 | A1 * | 2/2019 | Marks | G07F 17/3262 |
| 2019/0206191 | A1 * | 7/2019 | Halvorson | G07F 17/3262 |
| 2020/0111312 | A1 | 4/2020 | Olive | |

FOREIGN PATENT DOCUMENTS

| | | |
|---|---|---|
| AU | 2014202042 | 5/2014 |
| AU | 2017101097 A4 | 9/2017 |
| EP | 0984408 | 3/2000 |

OTHER PUBLICATIONS

Office Action dated Jun. 4, 2020 for U.S. Appl. No. 29/622,662 (pp. 1-8).
Notice of Allowance dated Aug. 31, 2020 for U.S. Appl. No. 29/622,662 (pp. 1-7).
Notice of Allowance dated Jan. 13, 2021 for U.S. Appl. No. 16/455,166 (pp. 1-9).
Office Action dated Jan. 7, 2021 for U.S. Appl. No. 16/679,694 (pp. 1-8).
Notice of Allowance dated Dec. 1, 2020 for U.S. Appl. No. 16/383,435 (pp. 1-7).
Office Action dated Sep. 2, 2020 for U.S. Appl. No. 16/383,435 (pp. 1-7).
Office Action dated Jan. 27, 2021 for U.S. Appl. No. 16/537,223 (pp. 1-13).
Australian Examination Report for Application No. 2019200719, dated Apr. 8, 2020, 3 pages.
Australian Examination Report for Application No. 2018241080, dated Sep. 24, 2019.
U.S. Appl. No. 16/455,166, filed Jun. 27, 2019, System and Method for Providing a Feature Game.
Australian Examination Report for Application No. 2018278882, dated Dec. 9, 2019, 2 pages.
Australian Examination Report for AU2016100230, dated May 11, 2016, 5 pages.
Australian Examination Report for AU2015210489, dated Jun. 14, 2016, 5 pages.

(56) References Cited

OTHER PUBLICATIONS

Australian Examination Report for AU2016202727, dated Jul. 4, 2016, 5 pages.
Australian Examination Report for AU2017101629, dated Jan. 16, 2018, 3 pages.
Australian Examination Report for AU2017204560, dated Feb. 1, 2018, 3 pages.
Australian Examination Report for AU2017101097, dated Dec. 7, 2017, 3 pages.
Notice of Allowance dated Mar. 18, 2021 for U.S. Appl. No. 16/455,166 (pp. 1-7).
Notice of Allowance dated Apr. 20, 2021 for U.S. Appl. No. 16/679,694 (pp. 1-8).
Office Action dated May 11,2021 for U.S. Appl. No. 16/537,223 (pp. 1-21).
Office Action dated May 27, 2021 for U.S. Appl. No. 16/679,694 (pp. 1-7).
Office Action dated Jun. 8, 2021 for U.S. Appl. No. 16/674,308 (pp. 1-7).
Office Action dated Jun. 10, 2021 for U.S. Appl. No. 16/455,166 (pp. 1-7).
Office Action dated Jun. 24, 2021 for U.S. Appl. No. 16/733,933 (pp. 1-8).
Office Action dated Jul. 9, 2021 for U.S. Appl. No. 16/703,602 (pp. 1-10).
Office Action (Non-Final Rejection) dated Sep. 16, 2021 for U.S. Appl. No. 16/782,615 (pp. 1-6).
Office Action (Notice of Allowance and Fees Due (PTOL-85)) dated Sep. 15, 2021 for U.S. Appl. No. 16/679,694 (pp. 1-7).
Office Action (Notice of Allowance and Fees Due (PTOL-85)) dated Sep. 17, 2021 for U.S. Appl. No. 16/740,774 (pp. 1-8).
Office Action (Non-Final Rejection) dated Oct. 4, 2021 for U.S. Appl. No. 16/783,593 (pp. 1-9).
Office Action (Notice of Allowance and Fees Due (PTOL-85)) dated Oct. 14, 2021 for U.S. Appl. No. 16/733,933 (pp. 1-7).
Australian Examination Report No. 1 for App. No. AU2020239761, dated Oct. 11, 2021, 6 pages.
Office Action (Notice of Allowance and Fees Due (PTOL-85)) dated Nov. 2, 2021 for U.S. Appl. No. 16/703,602 (pp. 1-7).
Office Action (Notice of Allowance and Fees Due (PTOL-85)) dated Nov. 4, 2021 for U.S. Appl. No. 16/455,166 (pp. 1-7).
Office Action (Notice of Allowance and Fees Due (PTOL-85)) dated Nov. 4, 2021 for U.S. Appl. No. 16/674,308 (pp. 1-7).

* cited by examiner

SYSTEM AND METHOD FOR PROVIDING A FEATURE GAME

RELATED APPLICATIONS

This application is a continuation of U.S. patent application Ser. No. 16/455,166, filed Jun. 27, 2019, which is a continuation of U.S. patent application Ser. No. 15/986,192, filed May 22, 2018, which is a continuation of U.S. patent application Ser. No. 14/823,536, filed Aug. 11, 2015, which claims priority to Australian Provisional Patent Application No. 2014903132 having an International filing date of Aug. 11, 2014, all of which are incorporated herein by reference in their entirety.

BACKGROUND OF THE INVENTION

In existing gaming systems, feature games may be triggered for players in addition to the base game. A feature game gives players an additional opportunity to win prizes, or the opportunity to win larger prizes, than would otherwise be available in the base game. Feature games can also offer altered game play to enhance player enjoyment.

While such gaming systems provide players with enjoyment, a need exists for alternative methods to provide feature games in gaming systems, and for a larger variety of types of feature games, in order to maintain or increase player enjoyment.

BRIEF SUMMARY OF THE INVENTION

According to one aspect of the invention there is provided a gaming machine comprising:

a symbol selector for selecting a plurality of symbols from a set of symbols for display during play of a base game, the set of symbols including a plurality of non-configurable symbols and a plurality of configurable symbols;

a random number generator for generating random prize values;

a value assigner for assigning a generated random prize value to each selected configurable symbol; and an outcome evaluator for monitoring play of the base game, wherein a feature game is triggered in response to a trigger event, the trigger event comprising a predefined number of the plurality of configurable symbols being selected by the symbol selector for display;

wherein, during the feature game, the symbol selector is further configured to:

1) hold the selected configurable symbols that comprise the trigger event on the display;
2) remove at least one of the selected non-configurable symbols from the display; and
3) replace any removed non-configurable symbol with another symbol selected from the set of symbols.

In an embodiment, the configurable symbols each comprise at least a common component and a variable component, the variable component being indicative of a value of a prize that is associated with each of the configurable symbol. At least one of the values of the respective prizes is generated by selecting one of a plurality of predefined multipliers that is applied to an amount wagered on the base game from which the feature is game triggered. The plurality of predefined multipliers are selected at random, a probability of selecting one of the plurality of predefined multipliers being weighted based at least in part on the amount wagered.

In this or additional embodiments, at least one of said values of the respective prizes comprises a predefined value.

Furthermore, at least one of the values of the respective prizes may comprise a progressive value which increments for each wager that is placed on the base game by an amount proportional to the wager.

In some embodiments, the gaming machine further comprises a configurable symbols counter for counting each of the configurable symbol that is selected for display in a base game. When the feature game is triggered, the configurable symbol counter is initiated to the number of selected configurable symbols that comprise the trigger event, and the configurable symbol counter is then incremented each time a configurable symbol is selected for display in the feature game. In this embodiment, a jackpot is awarded when the configurable symbol counter counts a predefined number of configurable symbols, the jackpot being a progressive prize that receives funding contributions from a plurality of other gaming machines.

In some embodiments, the gaming machine further comprises a free games counter for counting the number of free games to be awarded in the feature game, wherein a predefined number of free games is initially awarded when the feature game is triggered. The free games counter is reset to the predefined number of free games initially awarded each time a configurable symbol is selected for display in the feature game. The free game counter is then decremented each time no configurable symbols are selected for display in the feature game.

In some embodiments, the gaming machine further comprises an outcome evaluator for evaluating the outcome of the feature game and for awarding an accumulated prize based on the outcome, wherein the value of the accumulated prize is calculated by accumulating the respective prizes associated with each of the configurable symbols selected for display.

According to another aspect of the invention there is provided an electronic method of gaming on a gaming machine comprising the steps of:

selecting, using a symbol selector, a plurality of symbols from a set of symbols for display during play of a base game, the set of symbols including a plurality of non-configurable symbols and a plurality of configurable symbols;

generating, using a random number generator, random prize values;

assigning, using a value assigner, a generated random prize value to each selected configurable symbol;

monitoring, using an outcome evaluator, play of the base game, wherein a feature game is triggered in response to a trigger event, the trigger event comprising a predefined number of the plurality of configurable symbols being selected by the symbol selector for display; and using the symbol selector during the feature game to:

1) hold the selected configurable symbols that comprise the trigger event on the display;
2) remove at least one of the selected non-configurable symbols from the display; and
3) replace any removed non-configurable symbol with another symbol selected from the set of symbols.

According to another aspect of the invention there is provided a gaming machine comprising:

a symbol selector for selecting symbols from a set of symbols during play of a game, the set of symbols including a plurality of non-configurable symbols and a plurality of configurable symbols;

a value assigner for assigning a random prize value to each selected configurable symbol; and wherein, during at least part of play of the game, the symbol selector is further configured to:

1) hold selected configurable symbols on the display;
2) remove at least one selected non-configurable symbol from the display; and
3) replace any removed non-configurable symbol by selecting another symbol from the set of symbols.

In an embodiment, the at least part of play of the game is a feature game.

In an embodiment, the feature game is initiated in response to a trigger event in a base game.

In an embodiment, during the feature game the symbol selector selects symbols from a plurality of reel strips associated with individual ones of the display positions at which a configurable symbol has not been held.

According to another aspect of the invention there is provided an electronic method of gaming on a gaming machine comprising the steps of:

selecting, using a symbol selector, symbols from a set of symbols during play of a game, the set of symbols including a plurality of non-configurable symbols and a plurality of configurable symbols;

assigning, using a value assigner for a random prize value to each selected configurable symbol; and during at least part of play of the game:

1) holding selected configurable symbols on the display;
2) removing at least one selected non-configurable symbol from the display; and
3) replacing any removed non-configurable symbol by selecting another symbol from the set of symbols.

According to another aspect of the invention there is provided a computer program code which when executed by components of a controller of a gaming system implements the above method.

According to another aspect of the invention there is provided a tangible computer readable medium comprising the above computer program code.

BRIEF DESCRIPTION OF SEVERAL VIEWS OF THE DRAWINGS

Features and advantages of certain embodiments of the present invention will become apparent from the following description of embodiments thereof, by way of example only, with reference to the accompanying drawings, in which.

Figure 1:
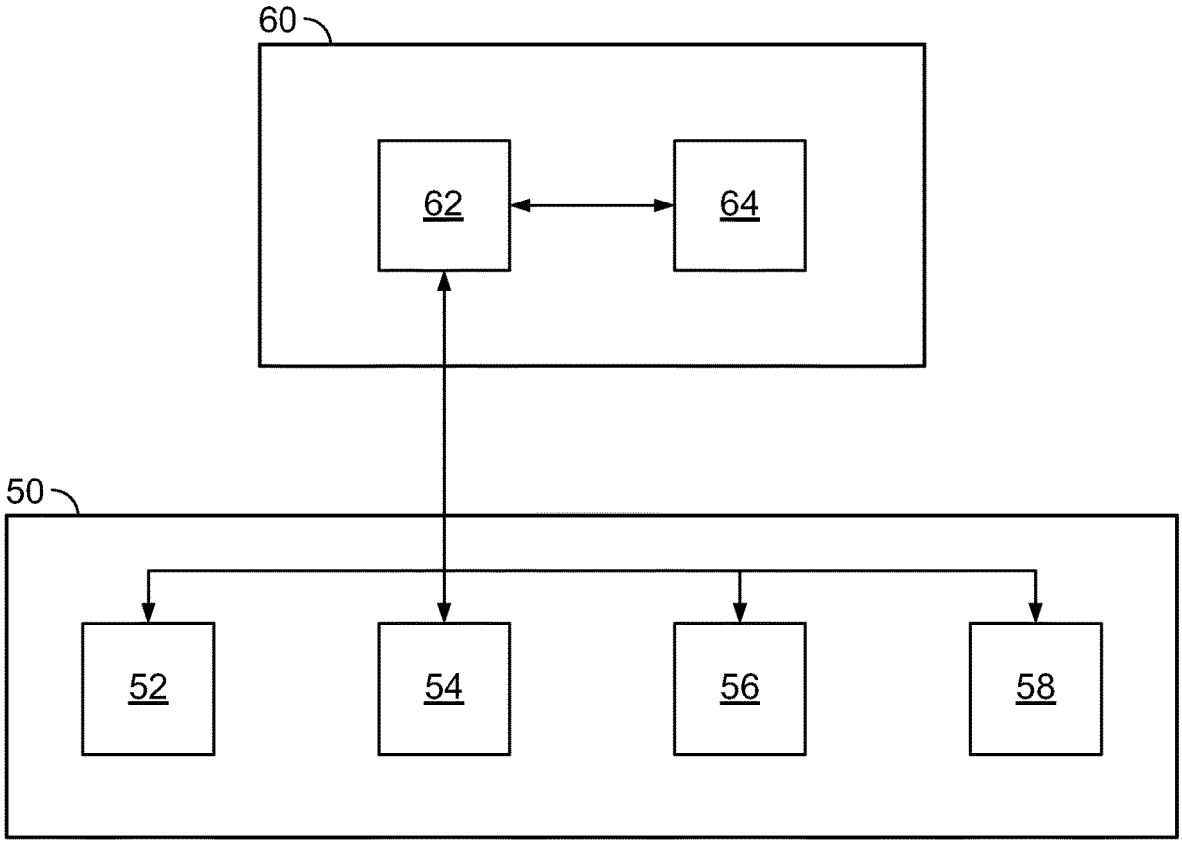
FIG. 1 is a block diagram of the core components of a gaming system.

The foregoing summary, as well as the following detailed description of certain embodiments of the present invention, will be better understood when read in conjunction with the appended drawings. For the purpose of illustrating the invention, certain embodiments are shown in the drawings. It should be understood, however, that the present invention is not limited to the arrangements and instrumentality shown in the attached drawings.

DETAILED DESCRIPTION OF THE INVENTION

Referring to the drawings, there are shown example embodiments of gaming systems having components which are arranged to implement a base game, from which may be triggered a feature game. In these embodiments, symbols are selected from a set of symbols comprising a plurality of configurable symbols and non-configurable symbols. In one example, the gaming system is configured so that a feature game is triggered when six of the configurable symbols are selected for display. The invention is not limited to triggering a feature game only when six configurable symbols are selected, however. In other embodiments, any number of configurable symbols may trigger the feature game.

Furthermore, each of the configurable symbols comprises a variable portion which is indicative of the value of a prize. When the feature game is triggered, the player is guaranteed to win the accumulated value of the prizes indicated by the variable portions of the configurable symbols.

General Construction of Gaming System

The gaming system can take a number of different forms. In a first form, a standalone gaming machine is provided wherein all or most components required for implementing the game are present in a player operable gaming machine.

In a second form, a distributed architecture is provided wherein some of the components required for implementing the game are present in a player operable gaming machine and some of the components required for implementing the game are located remotely relative to the gaming machine. For example, a "thick client" architecture may be used wherein part of the game is executed on a player operable gaming machine and part of the game is executed remotely, such as by a gaming server; or a "thin client" architecture may be used wherein most of the game is executed remotely such as by a gaming server and a player operable gaming machine is used only to display audible and/or visible gaming information to the player and receive gaming inputs from the player.

However, it will be understood that other arrangements are envisaged. For example, an architecture may be provided wherein a gaming machine is networked to a gaming server and the respective functions of the gaming machine and the gaming server are selectively modifiable. For example, the gaming system may operate in standalone gaming machine mode, "thick client" mode or "thin client" mode depending on the game being played, operating conditions, and so on. Other variations will be apparent to persons skilled in the art.

Irrespective of the form, the gaming system 1 has several core components. At the broadest level, the core components are a player interface 50 and a game controller 60 as illustrated in FIG. 1. The player interface is arranged to enable manual interaction between a player and the gaming system and for this purpose includes the input/output components required for the player to enter instructions to play the game and observe the game outcomes.

Components of the player interface may vary from embodiment to embodiment but will typically include a credit mechanism 52 to enable a player to input credits and receive payouts, one or more displays 54, a game play mechanism 56 including one or more input devices that enable a player to input game play instructions (e.g. to place a wager), and one or more speakers 58.

The game controller 60 is in data communication with the player interface and typically includes a processor 62 that processes the game play instructions in accordance with game play rules and outputs game play outcomes to the display. Typically, the game play rules are stored as program code in a memory 64 but can also be hardwired. Herein the term "processor" is used to refer generically to any device that can process game play instructions in accordance with game play rules and may include: a microprocessor, microcontroller, programmable logic device or other computational device, a general purpose computer (e.g. a PC) or a server. That is a processor may be provided by any suitable logic circuitry for receiving inputs, processing them in accordance with instructions stored in memory and generating outputs (for example on the display). Such processors are sometimes also referred to as central processing units (CPUs). Most processors are general purpose units, however, it is also know to provide a specific purpose processor using an application specific integrated circuit (ASIC) or a field programmable gate array (FPGA).

Figure 2:
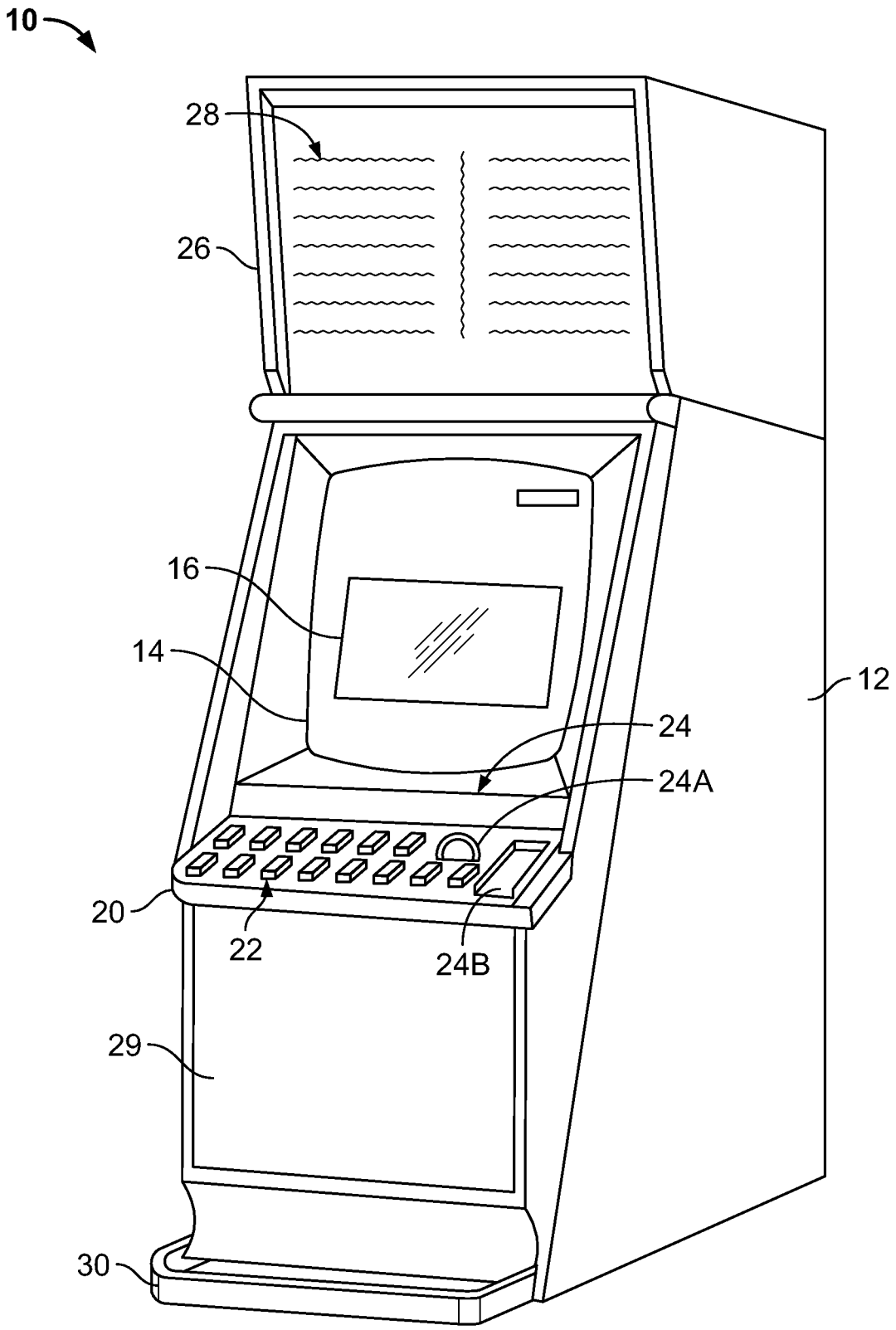
FIG. 2 is a perspective view of a standalone gaming machine.

A gaming system in the form of a standalone gaming machine 10 is illustrated in FIG. 2. The gaming machine 10 includes a console 12 having a display 14 on which are displayed representations of a game 16 that can be played by a player. A mid-trim 20 of the gaming machine 10 houses a bank of buttons 22 for enabling a player to interact with the gaming machine, in particular during game play. The mid-trim 20 also houses a credit input mechanism 24 which in this example includes a coin input chute 24A and a bill collector 24B. Other credit input mechanisms may also be employed, for example, a card reader for reading a smart card, debit card or credit card. Other gaming machines may configure for ticket in such that they have a ticket reader for reading tickets having a value and crediting the player based on the face value of the ticker. A player marketing module (not shown) having a reading device may also be provided for the purpose of reading a player tracking device, for example as part of a loyalty program. The player tracking device may be in the form of a card, flash drive or any other portable storage medium capable of being read by the reading device. In some embodiments, the player marketing module may provide an additional credit mechanism, either by transferring credits to the gaming machine from credits stored on the player tracking device or by transferring credits from a player account in data communication with the player marketing module.

A top box 26 may carry artwork 28, including for example pay tables and details of bonus awards and other information or images relating to the game. Further artwork and/or information may be provided on a front panel 29 of the console 12. A coin tray 30 is mounted beneath the front panel 29 for dispensing cash payouts from the gaming machine 10.

The display 14 shown in FIG. 2 is in the form of a video display unit, particularly a liquid crystal display. Alternatively, the display 14 may be a OLED, plasma screen, any other suitable video display unit. The top box 26 may also include a display, for example a video display unit, which may be of the same type as the display 14, or of a different type.

Figure 3:
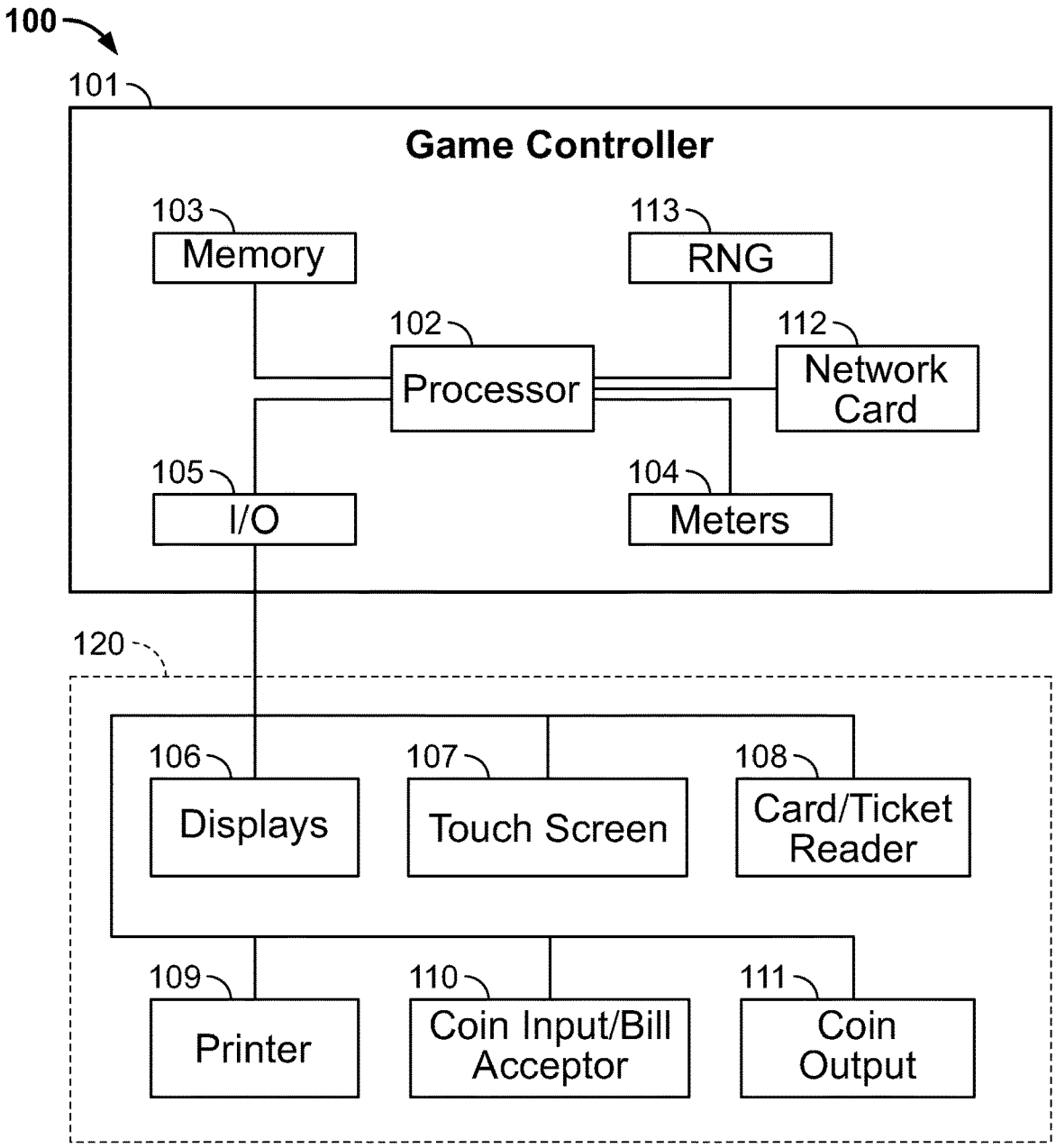
FIG. 3 is a block diagram of the functional components of a gaming machine.

FIG. 3 shows a block diagram of operative components of a typical gaming machine which may be the same as or different to the gaming machine of FIG. 2.

The gaming machine 10 includes a game controller 101 having a processor 102 mounted on a circuit board. Instructions and data to control operation of the processor 102 are stored in a memory 103, which is in data communication with the processor 102. Typically, the gaming machine 10 will include both volatile and non-volatile memory and more than one of each type of memory, with such memories being collectively represented by the memory 103.

The gaming machine has hardware meters 104 for purposes including ensuring regulatory compliance and monitoring player credit, an input/output (I/O) interface 105 for communicating with peripheral devices of the gaming machine 100. The input/output interface 105 and/or the peripheral devices may be intelligent devices with their own memory for storing associated instructions and data for use with the input/output interface or the peripheral devices. A random number generator module 113 generates random numbers for use by the processor 102. Persons skilled in the art will appreciate that the reference to random numbers includes pseudo-random numbers.

In the example shown in FIG. 3, a player interface 120 includes peripheral devices that communicate with the game controller 101 including one or more displays 106, a touch screen and/or buttons 107 (which provide a game play mechanism), a card and/or ticket reader 108, a printer 109, a bill acceptor and/or coin input mechanism 110 and a coin output mechanism 111. Additional hardware may be included as part of the gaming machine 100, or hardware may be omitted as required for the specific implementation. For example, while buttons or touch screens are typically used in gaming machines to allow a player to place a wager and initiate a play of a game any input device that enables the player to input game play instructions may be used. For example, in some gaming machines a mechanical handle is used to initiate a play of the game. Persons skilled in the art will also appreciate that a touch screen can be used to emulate other input devices, for example, a touch screen can display virtual buttons which a player can "press" by touching the screen where they are displayed.

In addition, the gaming machine 100 may include a communications interface, for example a network card 112. The network card may, for example, send status information, accounting information or other information to a bonus controller, central controller, server or database and receive data or commands from the bonus controller, central controller, server or database. In embodiments employing a player marketing module, communications over a network may be via player marketing module—i.e. the player marketing module may be in data communication with one or more of the above devices and communicate with it on behalf of the gaming machine.

Figure 4:
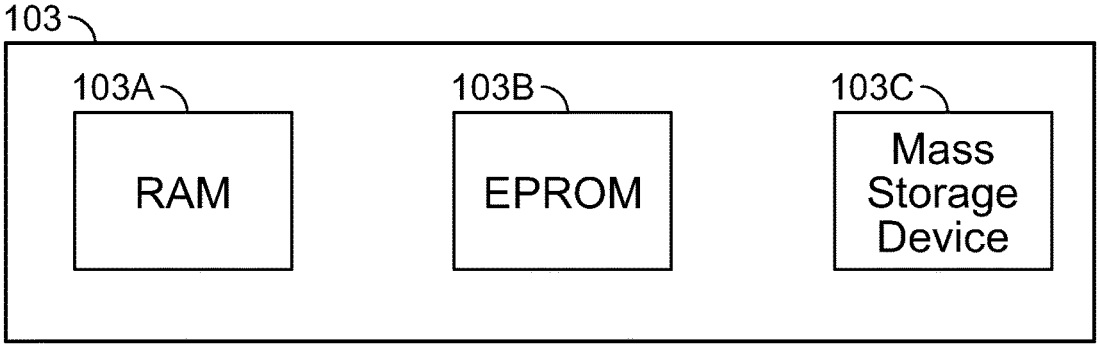
FIG. 4 is a schematic diagram of the functional components of a memory.

FIG. 4 shows a block diagram of the main components of an exemplary memory 103. The memory 103 includes RAM 103A, EPROM 103B and a mass storage device 103C. The RAM 103A typically temporarily holds program files for execution by the processor 102 and related data. The EPROM 103B may be a boot ROM device and/or may contain some system or game related code. The mass storage device 103C is typically used to store game programs, the integrity of which may be verified and/or authenticated by the processor 102 using protected code from the EPROM 103B or elsewhere.

It is also possible for the operative components of the gaming machine 100 to be distributed, for example input/output devices 106,107,108,109,110,111 to be provided remotely from the game controller 101.

Figure 5:
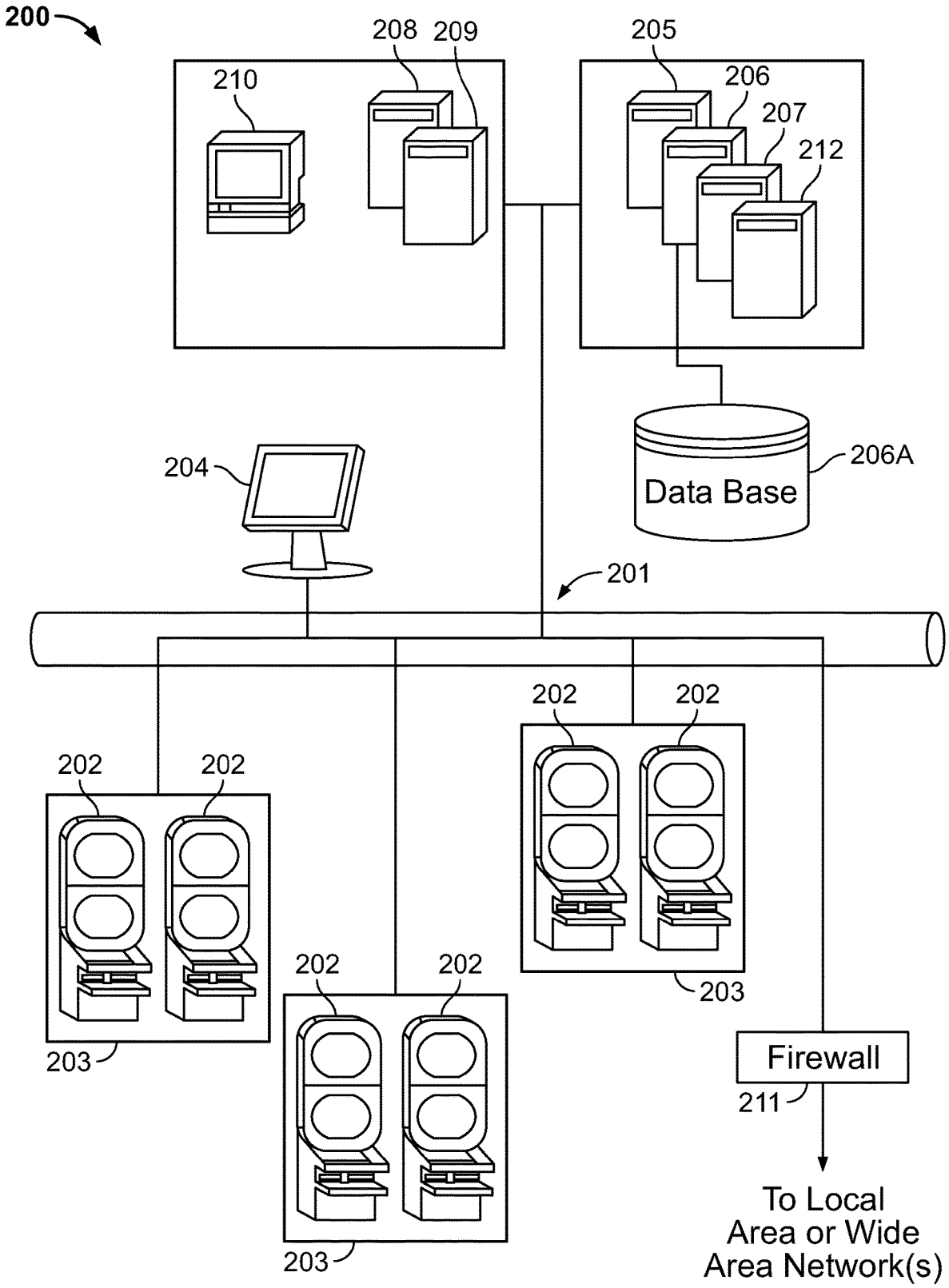
FIG. 5 is a schematic diagram of a network gaming system.

FIG. 5 shows a gaming system 200 in accordance with an alternative embodiment. The gaming system 200 includes a network 201, which for example may be an Ethernet network. Gaming machines 202, shown arranged in three banks 203 of two gaming machines 202 in FIG. 5 are connected to the network 201. The gaming machines 202 provide a player operable interface and may be the same as the gaming machines 10,100 shown in FIGS. 2 and 3, or may have simplified functionality depending on the requirements for implementing game play. While banks 203 of two gaming machines are illustrated in FIG. 5, banks of one, three or more gaming machines are also envisaged.

One or more displays 204 may also be connected to the network 201. For example, the displays 204 may be associated with one or more banks 203 of gaming machines. The displays 204 may be used to display representations associated with game play on the gaming machines 202, and/or used to display other representations, for example promotional or informational material.

In a thick client embodiment, game server 205 implements part of the game played by a player using a gaming machine 202 and the gaming machine 202 implements part of the game. With this embodiment, as both the game server and the gaming device implement part of the game, they collectively provide a game controller. A database management server 206 may manage storage of game programs and associated data for downloading or access by the gaming devices 202 in a database 206A. Typically, if the gaming system enables players to participate in a Jackpot game, a Jackpot server 207 will be provided to perform accounting functions for the Jackpot game. A loyalty program server 212 may also be provided.

In a thin client embodiment, game server 205 implements most or all of the game played by a player using a gaming machine 202 and the gaming machine 202 essentially provides only the player interface. With this embodiment, the game server 205 provides the game controller. The gaming machine will receive player instructions, pass these to the game server which will process them and return game play outcomes to the gaming machine for display. In a thin client embodiment, the gaming machines could be computer terminals, e.g. PCs running software that provides a player interface operable using standard computer input and output components. Other client/server configurations are possible, and further details of a client/server architecture can be found in WO 2006/052213 and PCT/SE2006/000559, the disclosures of which are incorporated herein by reference.

Servers are also typically provided to assist in the administration of the gaming network 200, including for example a gaming floor management server 208, and a licensing server 209 to monitor the use of licenses relating to particular games. An administrator terminal 210 is provided to allow an administrator to run the network 201 and the devices connected to the network.

The gaming system 200 may communicate with other gaming systems, other local networks, for example a corporate network, and/or a wide area network such as the Internet, for example through a firewall 211.

Persons skilled in the art will appreciate that in accordance with known techniques, functionality at the server side of the network may be distributed over a plurality of different computers. For example, elements may be run as a single "engine" on one server or a separate server may be provided. For example, the game server 205 could run a random generator engine. Alternatively, a separate random number generator server could be provided. Further, persons skilled in the art will appreciate that a plurality of game servers could be provided to run different games or a single game server may run a plurality of different games as required by the terminals.

Further Detail of Gaming System

The player operates the game play mechanism 56 to specify a wager and hence the win entitlement which will be evaluated for this play of the game and initiates a play of the game. Persons skilled in the art will appreciate that a player's win entitlement will vary from game to game dependent on player selections. In most spinning reel games, it is typical for the player's entitlement to be affected by the amount they wager and selections they make (i.e. the nature of the wager). For example, a player's win entitlement may be based on how many lines they play in each game—e.g. a minimum of one line up to the maximum number of lines allowed by the game (noting that not all permutations of win lines may be available for selection) and how much they wager per line. Such win lines are typically formed by a combination of symbol display positions, one from each reel, the symbol display positions being located relative to one another such that they form a line.

In many games, the player's win entitlement is not strictly limited to the lines they have selected, for example, "scatter" pays are awarded independently of a player's selection of paylines and are an inherent part of the win entitlement.

Persons skilled in the art will appreciate that in other embodiments, the player may obtain a win entitlement by selecting a number of reels to play and an amount to wager per reel. Such games are marketed under the trade name "Reel Power" by Aristocrat Leisure Industries Pty Ltd. The selection of the reel means that each displayed symbol of the reel can be substituted for a symbol at one or more designated display positions. In other words, all symbols displayed at symbol display positions corresponding to a selected reel can be used to form symbol combinations with symbols displayed at a designated, symbol display positions of the other reels. For example, if there are five reels and three symbol display positions for each reel such that the symbol display positions comprise three rows of five symbol display positions, the symbols displayed in the centre row are used for non-selected reels. As a result, the total number of ways to win is determined by multiplying the number of active display positions of each reel, the active display positions being all display positions of each selected reel and the designated display position of the non-selected reels. As a result for five reels and fifteen display positions there are 243 ways to win.

Figure 6:
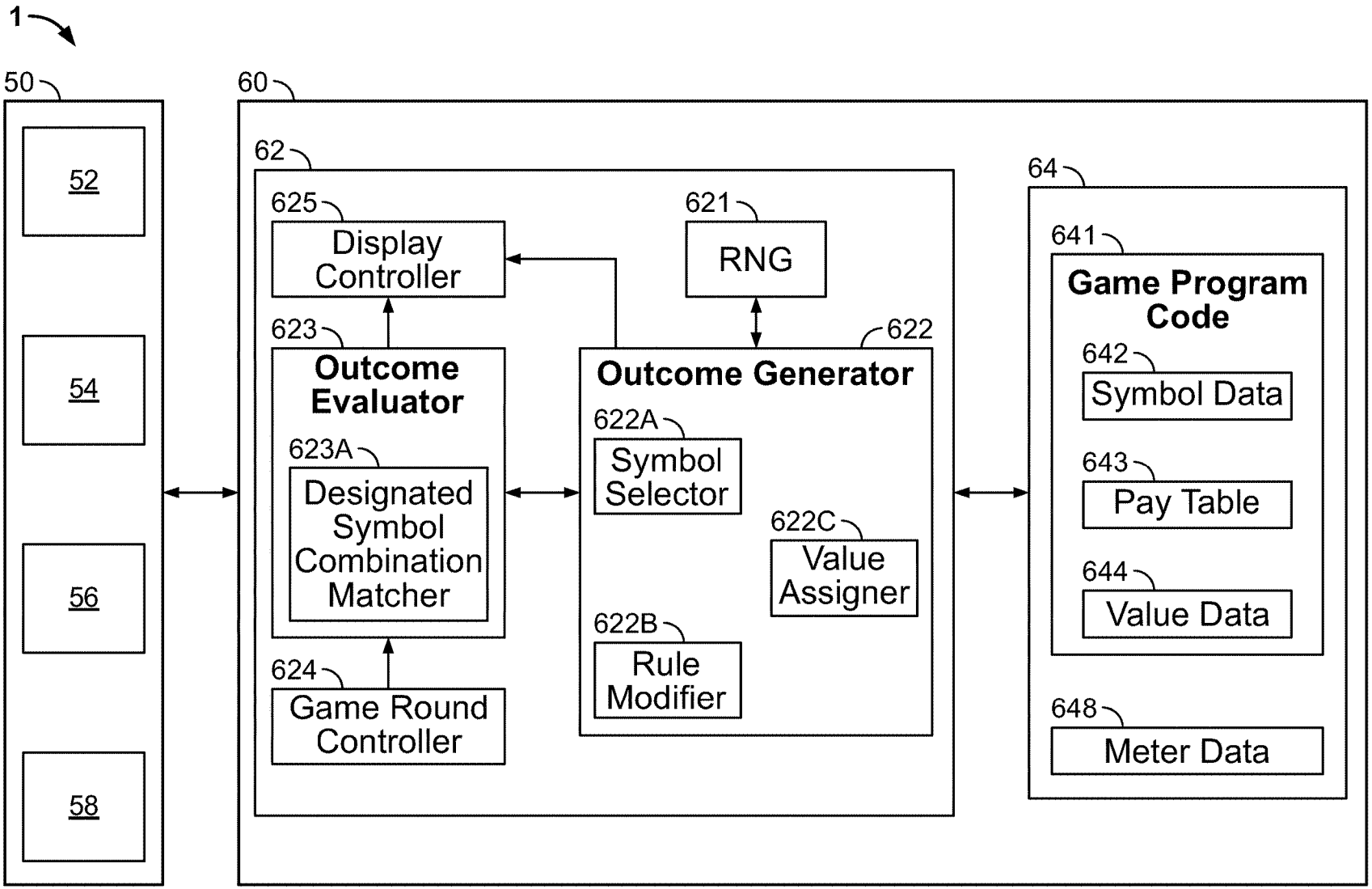
FIG. 6 is a further block diagram of a gaming system.

In FIG. 6, the processor 62 of game controller 60 of gaming system 1 is shown implementing a number of modules based on game program code 641 stored in memory 64. Persons skilled in the art will appreciate that various of the modules could be implemented in some other way, for example by a dedicated circuit.

These modules include the outcome generator 622 which operates in response to the player's operation of game play mechanism 56 to place a wager and initiate a play of the game and generates a game outcome which will then be evaluated by outcome evaluator 623. The first part of forming the game outcome is for a symbol selector 622A to select symbols from a set of symbols specified by symbol data 642 using random number generator 621. The selected symbols are advised to the display controller 625 which causes them to be displayed as a symbol display on display 54 at a set of display positions.

In the embodiment described below, the display positions of the symbol display are arranged in a rectangular matrix comprising a plurality of columns and a plurality of rows. However, in other arrangements as known in the gaming industry could be employed in embodiments of the invention. For example, in some arrangements there are more symbols in some columns than other, such as 3-4-3-4-3 arrangement of seventeen display positions corresponding to respective ones of five reels. In such arrangements, the columns of four symbols can be arranged so that they are off-set or staggered relative to the columns having two symbols so that the middle two symbols in the columns of four symbols share boundaries with two symbols of each neighbouring reel.

Figure 7:
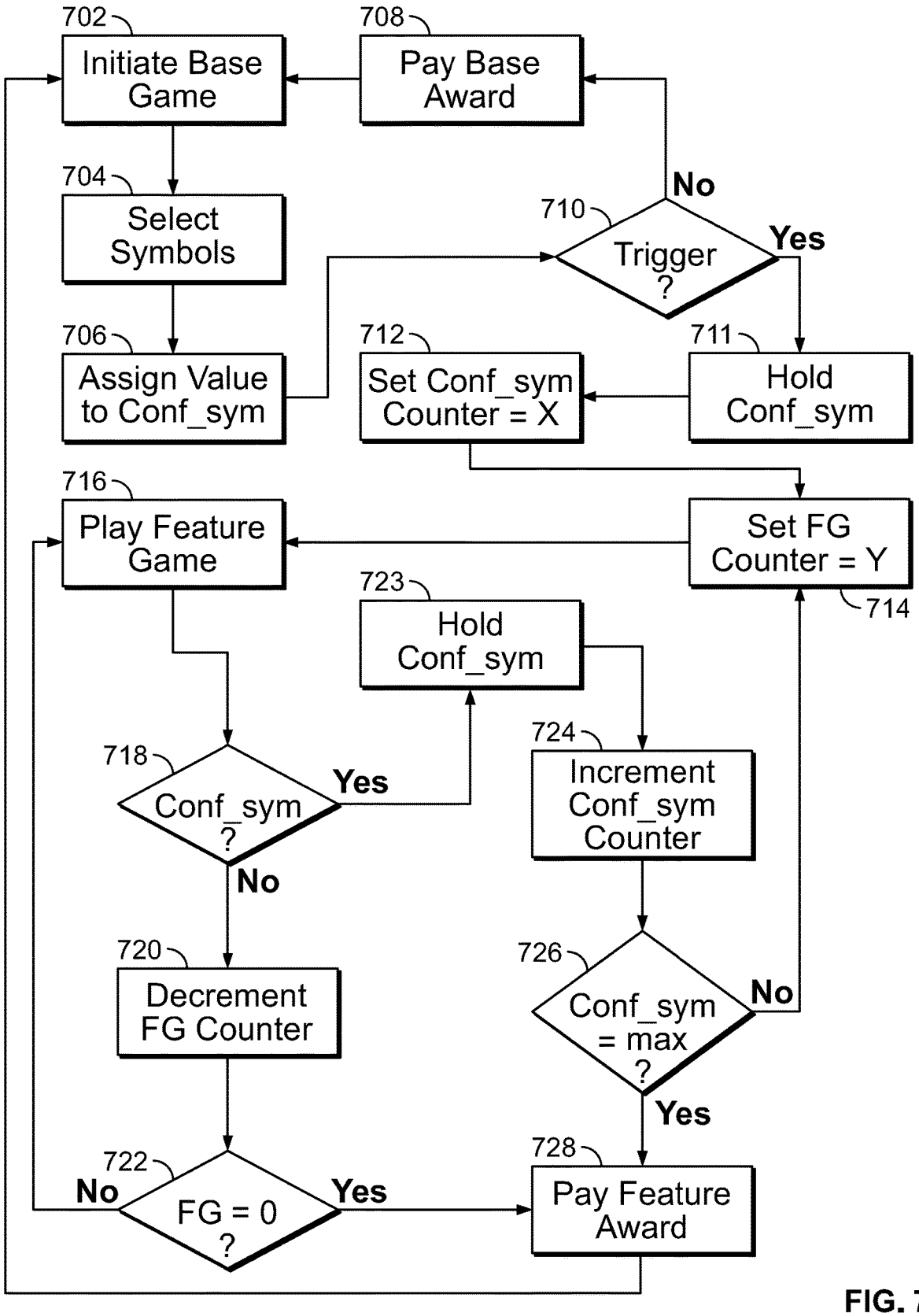
FIG. 7 is a flow diagram of a feature game of the gaming machine of FIG. 2.

FIG. 7 shows a flow diagram of one embodiment, in which a feature game may be triggered from play of the base game at step 702. In this embodiment, the base game comprises using symbol selector 622A to select a plurality of symbols from a set of symbols to display at the respective display positions arranged on display 54, at step 704. The set of symbols, which are stored as symbol data 642 in memory 64, comprises a plurality of configurable symbols and non-configurable symbols.

Figure 9B:
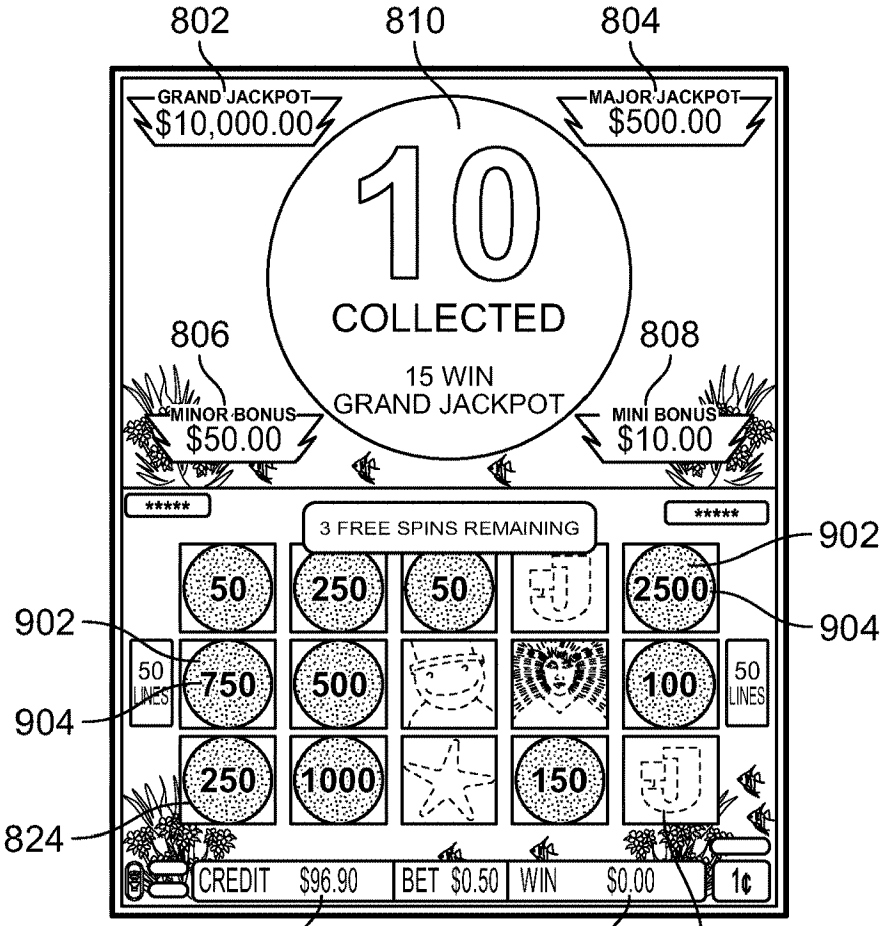
FIGS. 9A-9C are screen shots of the feature game of FIG. 7.
Figure 9A:
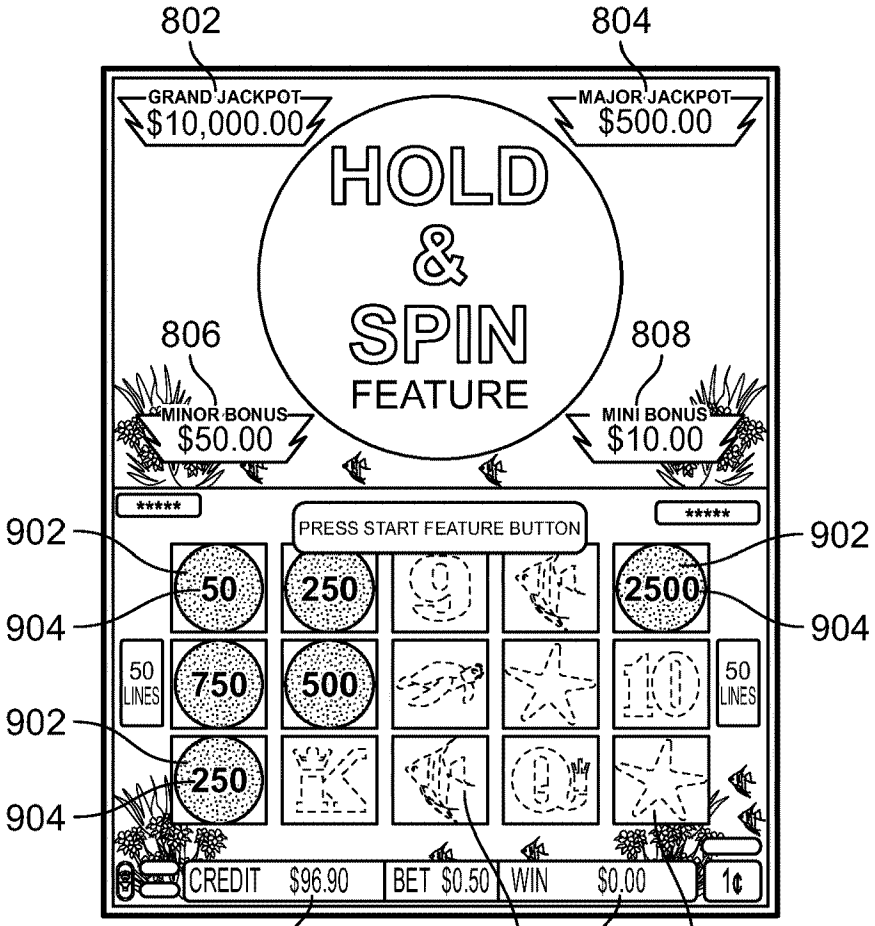
Figure 9C:
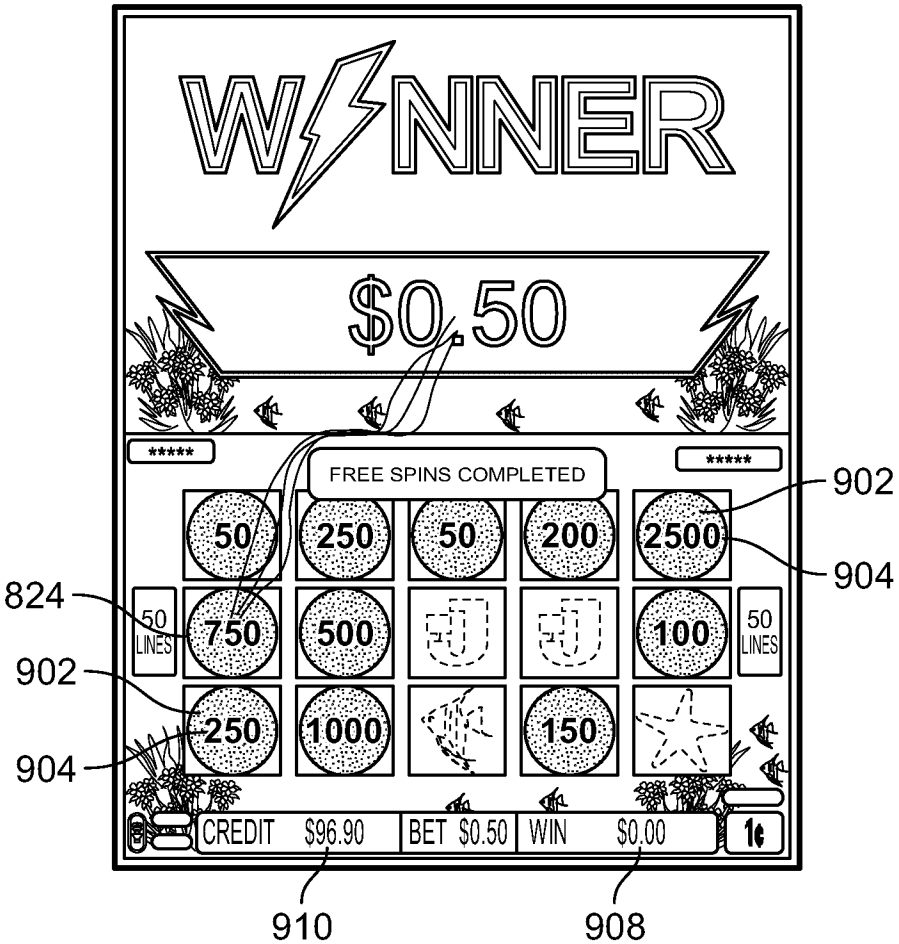
Figure 10B:
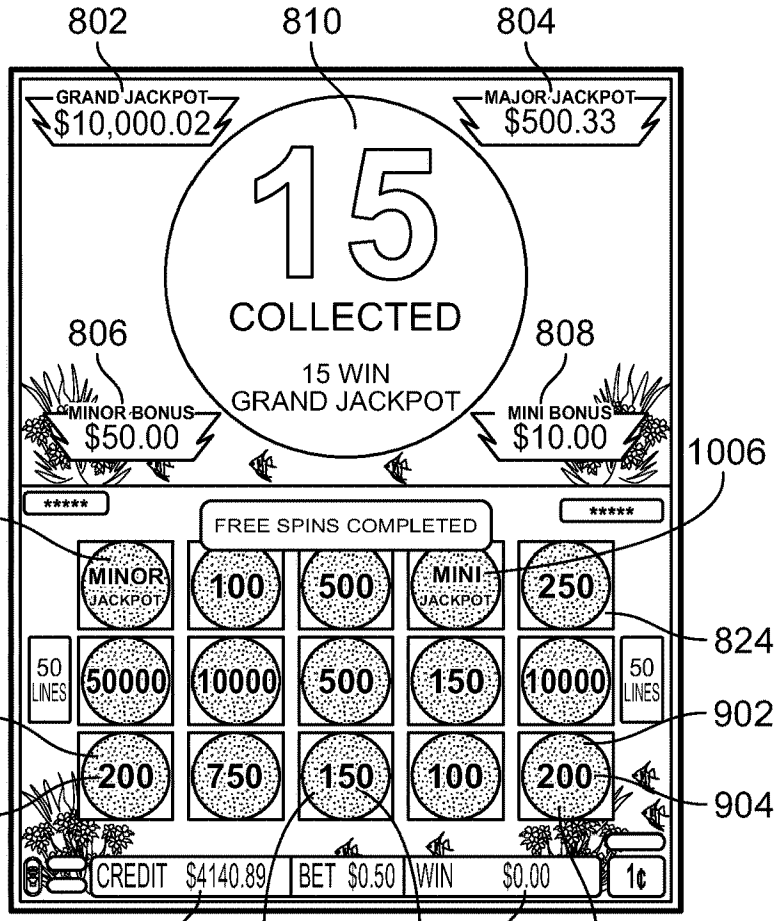
FIGS. 10A and 10B are screen shots of the feature game of FIG. 7, showing one of the progressive jackpot prizes being won.
Figure 10A:
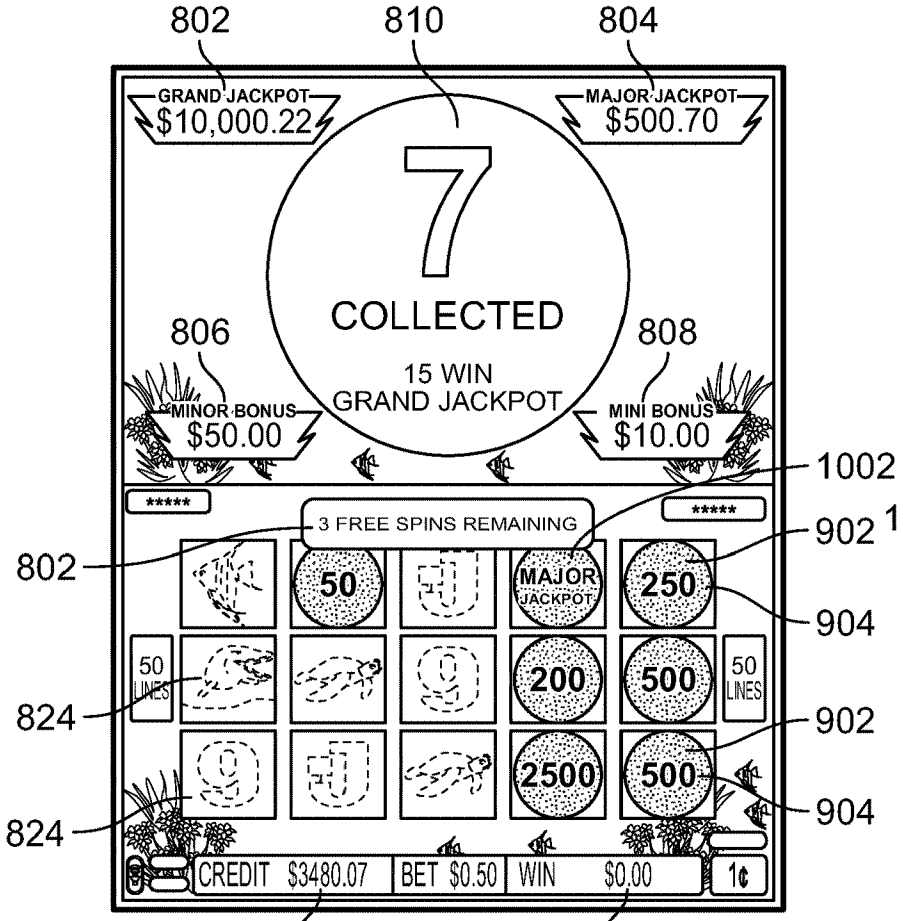

In an embodiment, the configurable symbols each comprise at least a common component and at least a variable component. The variable component is indicative of a value of a prize that is associated with each of the configurable symbols. An example of a configurable symbol is shown in FIGS. 9A-9C, in the form of a pearl symbol. The common component is the pearl itself 902, while the variable component is the indicia 904 overlaying pearl 902. In this case, indicia 902 are numerals directly indicative of the value of the prize. In other embodiments, such as shown in FIG. 10A-10B, the indicia indirectly indicate the value of the prize, such as "major" indicia 1002, "minor" indicia 1004 or "mini" indicia 1006. It will be appreciated that the indicia can also be in other forms, which may also be indicative of a prize. For example, the car icon indicates that the player has the opportunity to, or has, won a car. In some embodiments, the indicia may indicate only a portion of a prize. Continuing with the car example, the car icon may be split into four portions, each portion being assigned to a different configurable symbol. In such embodiments, all four portions of the car icon are required to be selected for display in order for the car prize to be won.

In one embodiment, at least one value of the respective prizes is generated by randomly selecting one of a plurality of predefined multipliers that is applied to an amount wagered on the base game from which the feature is game triggered. This is accomplished at step 706 using value assigner 622C, which selects the predefined multipliers from value data 644, applies the multiplier to the initial wager to obtain a prize value and assigns the prize value to each of the configurable symbols selected by symbol selector 622A. The plurality of predefined multipliers in this embodiment are selected at random according to a weighted probability based at least in part on the amount wagered on the base game. In an embodiment, the assignment of values to the configurable symbols is performed by the value assigner 622C after the symbols have been selected and the game controller knows they will be displayed but before they are displayed on the display. In another embodiment, the assignment occurs after the symbols have been displayed on display 54.

In this or other embodiments, at least one value of the respective prizes may comprise a predefined value and/or a jackpot. As used herein, the term "jackpot", as opposed to "prize", refers to a progressive prize which accumulates over multiple plays of the base game and/or the feature game. As will be appreciated, the jackpot may be funded from a variety of sources including from only the gaming machine 10 itself, or from a plurality of gaming machines 202—a so-called "link". Furthermore, the jackpot may be triggered by any means known in the art, such as by using a mystery trigger or by using the Hyperlink™ system developed by the applicant.

In another embodiment, the variable prizes may be randomly selected under the control of value assigner 622C from a set of available prizes. Specific prizes may be weighted so as to control the probability of certain prizes occurring. In some embodiments, there may be a plurality of sets of prizes and the value assigner 622C may be configured to choose the set of prizes from which values will be randomly selected on the basis of a player's wager in the base game.

Returning to FIG. 7, at step 710, outcome evaluator 623 monitors play of the base game and determines whether a trigger event has occurred. In this embodiment, a trigger event occurs when six configurable symbols appear on display 54. If a trigger event has not occurred, play of the base game continues and control reverts to step 702, once any awards are paid at step 708. However, if a trigger event does occur, the feature game initiates by first holding the configurable symbols in their respective display positions 824, at step 711. Outcome generator 622 causes the feature game to be displayed on display 54 by retrieving symbol data 642 from memory 64 and passing the data to display controller 625 which controls display 54 to display the feature game. In other embodiments, more than or less than six symbols will be required to trigger the feature game, or the feature game will be modified in a way that is proportional to the number of configurable symbols that are displayed to trigger the feature game. For example, the average or total prize achievable in the feature game may be increased in proportion to the number of configurable symbols appearing.

Figure 8:
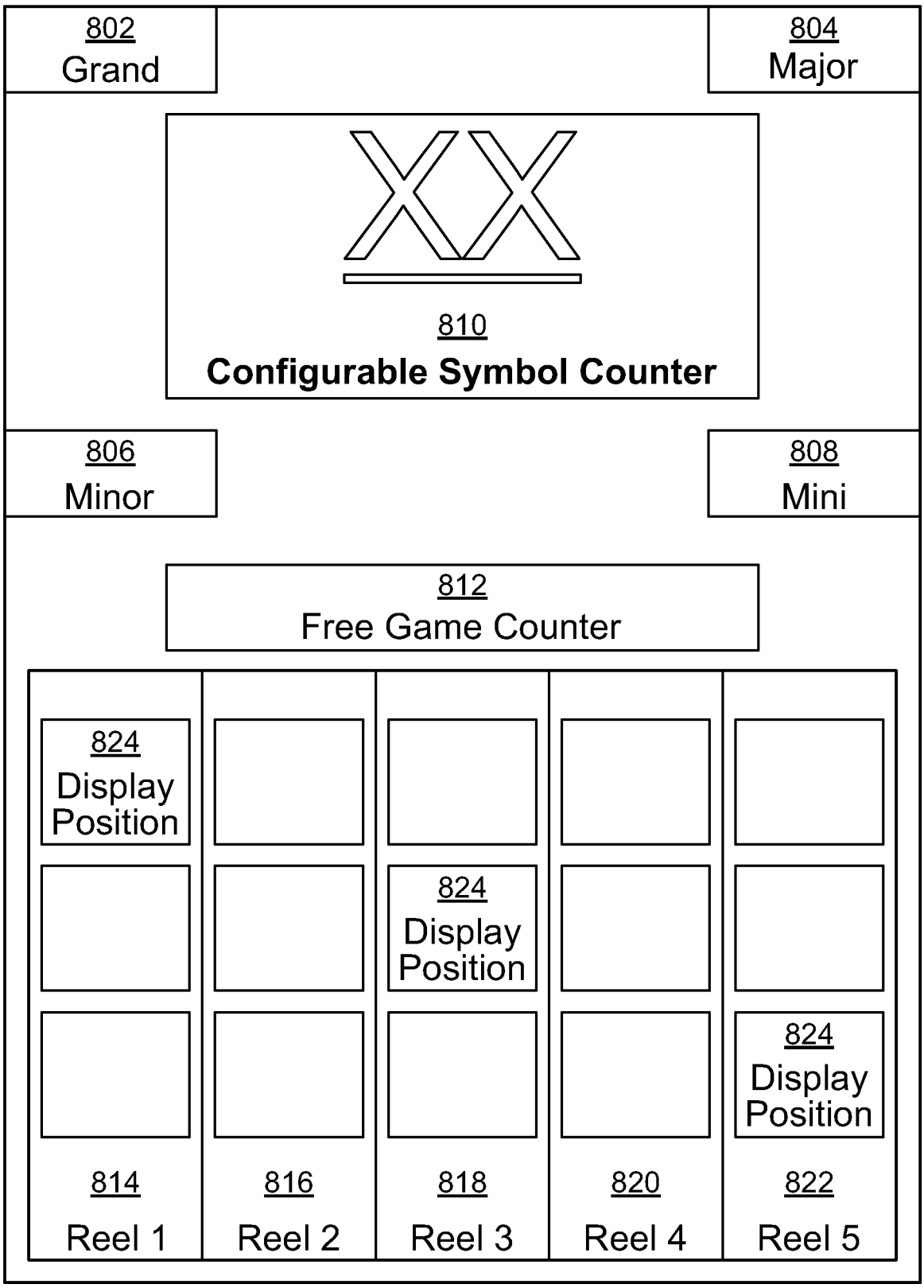
FIG. 8 is a representation of a screen of the feature game of FIG. 7.

When the feature game starts, the configurable symbol counter 810 of FIG. 8 is, in this embodiment, set to the number of configurable symbols that are held on reels 814-822 at step 712. In the preferred embodiment, this is also the number of configurable symbols which originally triggered the feature game. That is, in this embodiment, the configurable symbol counter 810 is initially set to 6, as six configurable symbols are required to trigger the feature game.

Once configurable symbol counter 810 is set, control moves to step 714 which sets free game counter 812 to the predefined number of free games. In an embodiment, the preferred number of free games is three, so counter 812 is set to 3. In other embodiments, the number of free games may be more than or less than three, or may be derived by the game controller from the number of configurable symbols that appear. For example, an additional free game may be offered for each configurable symbol that appears in addition to a predefined minimum required to trigger the feature game.

Then, similar to the base game, the symbol selector 622A selects symbols from symbol data 642 to be displayed in the other display positions 824 not already displaying a configurable symbol, via display controller 625 at step 716. Note that in this embodiment, symbols in the feature game are selected from the full set of symbols defined by symbol data 642, including any configurable symbols. In other embodiments, the symbols may be selected from a reduced set of symbols taking into account of the configurable symbols already held. In an alternative embodiment, the symbols may be selected from an increased set of symbols. For example, symbols may be purchased or otherwise awarded for addition to the reel strip prior to the initiating the feature game. If one or more configurable symbols are selected, value assigner 622C assigns randomly selected values to each configurable symbol.

Outcome evaluator 623 then monitors play of the feature game to determine whether a configurable symbol is selected and displayed at step 718. If a configurable symbol is not displayed, free game counter 812 is decremented by a predefined amount at step 720. In the preferred embodiment, free game counter 812 is only decremented by one, but of course the counter may be decremented by any number as is known in the art.

If there are a number of free games remaining as determined by controller 60 at step 722, control returns to step 716 to continue the feature game. On the other hand, once the number of free games is depleted, that is, when the free game counter 812 reaches zero, the feature game ends and control returns to step 702 after any prizes are paid at step 728. In one embodiment, the accumulated value of all the individual prizes as indicated by the variable components of the collected configurable symbol is paid at step 728.

Returning to step 718, if outcome evaluator 623 determines that at least one configurable symbol is displayed on reels 814-822, then that symbol is held on the reel and the configurable symbol counter 810 is incremented at step 724. Outcome evaluator 623 then checks whether a predefined number of configurable symbols has been displayed on reels 814-822 at step 726 and, if the predefined number has been reached, a jackpot is paid at step 728.

The predefined number of configurable symbols required to trigger a jackpot in this embodiment is fifteen. That is, for this embodiment in which a game is implemented using a 5×3 matrix, configurable symbols must be selected and displayed in all the matrix positions of reels 814-822. In other embodiments, the predefined number may be more than or less than fifteen. For example, in a 3-4-3-4-3 matrix configuration discussed as discussed above, the number of configurable symbols required to fill all matrix positions would be 17. In yet other embodiments, not all of the matrix positions need necessarily be filled, and the number of configurable symbols required may be determined randomly.

While in the above embodiments, the feature game ends when the Grand jackpot 802 is triggered at step 726, in other embodiments, the feature game does not necessarily end at this point. In such embodiments, one or more of reels 814-822 are configured to expand and display additional configurable or non-configurable symbols when counter 810 reaches the predefined number. For example, a game implemented using a 5×3 matrix may expand to a 3-4-3-4-3 configuration. In such embodiments, a prize in addition to the Grand jackpot 802 is paid if configurable symbols are also selected for display in those additional positions.

Alternatively, if outcome evaluator 623 determines that the predefined number of configurable symbols has not been reached at step 726, the feature game continues. In the embodiment of FIG. 7, each time a configurable symbol is displayed and the jackpot is not won, free game counter 812 is reset to the default position by returning control to step 714, which in this embodiment is three as noted above. Therefore, the number of free games awarded by the outcome evaluator 623 is indefinite and is not determined by a predefined limit.

In this or other embodiments, if no configurable symbols appear on reels 814-822 in any of the free games initially awarded, free games counter 812 is reset. Such embodiments ensure the player is guaranteed to win a prize over and above the prize payable for triggering the feature game.

In the above embodiments, the jackpot paid in response to counter 810 reaching the predefined threshold is Grand prize 802. The grand prize in this embodiment is a linked jackpot which receives contributions from a plurality of linked gaming machines and incremented based on the turnover of the linked machines. In some embodiments, a lower threshold of configurable symbols may be required for Major prize 804, Minor prize 806 or mini prize 808 to be won. Alternatively or additionally, as best shown in FIGS. 10A and 10B, Major, Minor and Mini prizes may be paid by assignment of those prizes to one of the configurable symbols, such as "major" indicia 1002, "minor" indicia 1004 or "mini" indicia 1006.

Note that in some embodiments, one or all of the Grand 802, Major 804, Minor 806 and Mini 808 prizes may all be implemented as jackpots, as fixed bonus amounts that do not increment or as a mixture of both. In the embodiment of FIGS. 9A to 10B, as noted above, Grand prize 802 is implemented as a linked progressive jackpot, while Major prize 804 is implemented as a standalone progressive (SAP) jackpot which only takes contributions from the gaming machine itself, incrementing the jackpot as a function of turnover. Minor 806 and Mini 808 prizes are implemented as fixed bonus amounts in proportion to the initial bet wagered. In some embodiments, Grand 802 prize may also be implemented as a SAP, or the Major 804 prize may also be implemented as a link.

This embodiment implements Grand 802 and Major 804 prizes as jackpots and, while both may be awarded simultaneously, neither can be awarded more than once in the same feature game. However, in other embodiments, either jackpot may be won multiple times within the same feature game. In such embodiments, players are awarded a seed value of the jackpot for subsequent triggers of that same jackpot.

As embodiments of the feature game described above automatically adjust awards based on turnover and proportionality to the initial wager, this invention is particularly suited to variable denomination games. Therefore, in some embodiments, controller 60 allows player selection of the minimum bet denomination. For example, before play of the game, controller 60 causes display controller 625 to output a message on display 54 requesting the player to select a minimum bet denomination. The player makes a selection through the game play mechanism 56 in response to which controller 60 adjusts the amount contributed to Grand 802 and Major 804 jackpot prizes and the magnitude of Minor 806 and Mini 808 bonus awards. Controller 60 also adjusts the weightings of the values in value data 644 from which value assigner 622C may assign to the configurable symbols. In one embodiment, there are four denominations available for selection, 1c, 2c, 5c and 10c. Those skilled in the art would appreciate that the denominations are not limited to four, but can include any suitable amount in any given currency. Note also that in this embodiment, while the selected denomination affects the magnitude of the Minor 806 and Mini 808 fixed bonus prizes offered, it does not affect the magnitude of the Grand 802 and Major 804 jackpots—only the contributions funding the amount.

EXAMPLES

More specific examples of embodiments of the invention are now described with reference to FIGS. 9A-10B. In general, as shown in these Figures, the game has a traditional 3×5 grid layout, and is referred to in the examples below as the "Hold & Spin" feature.

Referring to FIG. 9A, the Hold & Spin feature is triggered when six 6 pearl symbols 902 are selected for display. When triggered, pearls 902 are held in their respective display positions, being all of column 1, column 2 rows 1 and 2 and column 5 row 1, and the controller 60 waits for a player instruction to initiate the game through game play mechanism 56. In some embodiments, controller 60 will wait indefinitely while in other embodiments, controller 60 will wait for a predefined period of time before automatically initiating the game.

At this point, counter 810 is set to 6, and the player is guaranteed to win the accumulated value as indicated by the variable components 904 of the six pearls 902. That is, even before play of Hold & Spin starts, the player has won 4,300 credits in the embodiment of FIG. 9A.

Moving on to FIG. 9B, the player has spun an additional 4 pearls 902. Accordingly, counter 810 is incremented from 6 to 10 and free games counter 812 is reset to default, which is 3 free games in this embodiment. As compared to FIG. 9A, the additional pearls 902 are selected for display at display positions C2R3, C3R1, C4R3 and C5R2, and are also held at those positions for the subsequent games.

Over the remaining free games, the player spins only an additional one pearl 902, displayed at C4R1, as shown in FIG. 9C. Accordingly the free games end and the player wins the accumulated value of the values indicated on pearls 902. In this case, the total award is the 4,300 credits for the six pearls 902 that originally triggered the Hold & Spin game, plus the additional 5 pearls 902 selected during play of the Hold & Spin game—5,800 credits. In this embodiment, the accumulated award is totaled at the end of the Hold & Spin game and first transferred to the win meter 908 before being transferred to the credit meter 910 by the controller 60. Meter data 648 is adjusted accordingly before the next game can be initiated at step 702. In alternative embodiments, the accumulated award may bypass the win meter and be credited directly to the credit meter.

FIGS. 10A and 10B are examples showing the jackpots being own. In FIG. 10A, value assigner 622C has assigned "Major" indicia 1002 to pearl 902, which has been selected for display at C4R1. This triggers Major prize 804 which, in one embodiment, is paid directly into credit meter 910 rather than first into win meter 908. That is, jackpot wins are paid immediately when they are won rather than being accumulated at the end of the Hold & Spin game as per the other prizes described above. Thus in the FIG. 10A embodiment, Major jackpot 804 is paid when the associated pearl 902 is selected, while the remaining 4,000 credits will be accumulated and paid at the completion of the feature game, in addition to any new pearls 902 that are selected and displayed in the remaining free games. In alternative embodiments, the Major jackpot may be accumulated at the end of the feature game along with the other 4,000 credits, and the accumulated total may be paid first into win meter 908 or directly into credit meter 910.

FIG. 10B shows Grand jackpot 802 being triggered, as 15 pearls 902 have been selected for display in the matrix by the end of the feature game. Again, the Grand 802 jackpot is first accounted for and paid directly into credit meter 910, and the remaining prizes indicated by indicia 904 on pearls 902 are then accumulated and paid into win meter 908 before being transferred to credit meter 910. Therefore, in this FIG. 10B embodiment, the total winnings is made up of the initial Grand jackpot 802, plus 63,000 credits indicated by indicia 904 and Minor 806 and Mini 808 prizes indicated by "Minor" indicia 1004 and "Mini" indicia 1006. Again, in alternative embodiments, the Grand jackpot may be accumulated at the end of the feature game along with the other 63,000 credits, Minor prize 806 and Mini prize 808, and the accumulated total may be paid first into win meter 908 or directly into credit meter 910.

In another example, the configurable symbols may only be provided during part of the game, such as a feature game.

In another example, after a feature game is triggered, the game controller initiates a feature game using different reels to those used in the base game. Depending on the embodiment, the trigger may be the configurable symbol trigger described above or some other trigger, e.g. a symbol combination. In this example, in the feature game, individual reels are associated with each of the symbol display positions. That is, if there are fifteen symbol display positions, fifteen reels are used. Each of the reels comprises a mixture of non-configurable symbols and configurable symbols. Before the free games, the configurable symbol counter is set to zero. In the first free game, the symbol selector determines stopping positions for all of the reels. If any of the reels are stopped with a configurable symbol in place, that configurable symbol is held in position by holding/locking the reel (i.e. not spinning the reels in a subsequent free game). That is, in subsequent free games, only the reels corresponding to symbol positions where a configurable symbol has not been displayed are re-spun. Each configurable symbol is assigned a value by value assigner by selecting a prize value from a set of prize values. The set of prize values from which values are selected depends on the player's wager in the base game. As in the example, described above, a player is awarded the sum of the values of the configurable symbols at the end of the free games and may be awarded an additional prize such as a jackpot prize depending on what value the counter reaches during the free games.

In another example, the configurable symbol may have an alternative visual representation, for example, a door which opens once the configurable symbol is displayed in a display position to reveal the assigned prize value.

As indicated above, the method may be embodied in program code. The program code could be supplied in a number of ways, for example on a tangible computer readable storage medium, such as a disc or a memory device, e.g. an EEPROM, (for example, that could replace part of memory 103) or as a data signal (for example, by transmitting it from a server). Further, different parts of the program code can be executed by different devices, for example in a client server relationship. Persons skilled in the art, will appreciate that program code provides a series of instructions executable by the processor.

It is to be understood that, if any prior art is referred to herein, such reference does not constitute an admission that the prior art forms a part of the common general knowledge in the art in any country.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

What is claimed is:

1. A gaming machine, comprising:

a credit input mechanism;

a credit payout mechanism;

a display device;

a player interface; and a game controller executing instructions stored in a memory, wherein execution of the instructions cause the game controller to at least:

establish a credit balance in response to the credit input mechanism receiving a physical item with an associated credit value;

initiate play of a base game in response to a first input received via the player interface;

in response to initiating play of the base game:

spin a plurality of base game virtual reels to select and display a first plurality of symbols at a plurality of display positions on the display device;

in response to determining that a quantity of configurable symbols in the first plurality of symbols has a predetermined relationship to a predetermined quantity, trigger display of a feature game;

set a quantity of remaining games for the feature game to an initial quantity;

for each remaining game of the feature game, spin one or more feature game virtual reels to select and display symbols for one or more of the plurality of display positions with non-configurable symbols while holding configurable symbols at their respective display positions;

increase the credit balance per numeric prize indicia presented by configurable symbols at the plurality of display positions; and cause the credit payout mechanism to provide a payout from the credit balance in response to a second input received via the player interface.

2. The gaming machine of claim 1, wherein execution of the instructions further causes the game controller to determine the initial quantity for the quantity of remaining games to be equal to the quantity of configurable symbols displayed at the plurality of display positions.

3. The gaming machine of claim 1, wherein execution of the instructions further causes the game controller to determine the initial quantity for the quantity of remaining games to be equal to the predetermined quantity plus an additional quantity that is determined based, at least in part, on an amount by which the quantity of configurable symbols in the first plurality of symbols exceeds the predetermined quantity.

4. The gaming machine of claim 1, wherein execution of the instructions further causes the game controller to determine the initial quantity based, at least in part, on the quantity of configurable symbols in the first plurality of symbols.

5. The gaming machine of claim 1, wherein execution of the instructions further causes the game controller to increase an average prize that is achievable in the feature game in proportion to the quantity of configurable symbols in the first plurality of symbols.

6. The gaming machine of claim 1, wherein execution of the instructions further causes the game controller to increase a total prize that is achievable in the feature game in proportion to the quantity of configurable symbols in the first plurality of symbols.

7. The gaming machine of claim 1, wherein execution of the instructions further cause the game controller to:

decrease the quantity of remaining games after each spin of the one or more feature game virtual reels; and increase the quantity of remaining games in response to at least one configurable symbol being selected as a replacement symbol.

8. A method of operating a gaming machine, the method comprising:

establishing a credit balance in response to a credit input mechanism of the gaming machine receiving a physical item with an associated credit value;

receiving, via a player interface of the gaming machine, a wager funded by the credit balance;

updating the credit balance based on the wager;

during play of a base game of the gaming machine, spinning a plurality of base game virtual reels to select and display a plurality of symbols at a plurality of display positions on a display device;

in response to determining that a quantity of configurable symbols displayed at the plurality of display positions having a predetermined relationship to a predetermined quantity associated with a feature game, triggering display of the feature game; and setting a game play aspect of the feature game proportionally with respect to the quantity of configurable symbols displayed at the plurality of display positions;

for each remaining game of the feature game, spinning one or more feature game virtual reels to select and display symbols for one or more of the plurality of display positions with non-configurable symbols while holding any configurable symbols at their respective display position on the display device;

increasing the credit balance per numeric prize indicia presented by the configurable symbols at the plurality of display positions; and causing, a credit payout mechanism of the gaming machine to provide a payout from the credit balance in response to an input received via the player interface of the gaming machine.

9. The method of claim 8, wherein setting the game play aspect of the feature game comprises setting a quantity of remaining games for the feature game to an initial quantity determined based, at least in part, on the quantity of configurable symbols displayed at the plurality of display positions.

10. The method of claim 8, wherein setting the game play aspect of the feature game comprises setting a quantity of remaining games for the feature game to an initial quantity that is equal to the quantity of configurable symbols displayed at the plurality of display positions.

11. The method of claim 10, further comprising:

decreasing the quantity of remaining games after each spin of the one or more feature game virtual reels; and increasing the quantity of remaining games in response to at least one configurable symbol being selected as a replacement symbol.

12. The method of claim 8, wherein setting the game play aspect of the feature game comprises setting a quantity of remaining games for the feature game to an initial quantity that is equal to the predetermined quantity plus an additional quantity that is determined based, at least in part, on an amount by which the quantity of configurable symbols displayed at the plurality of display positions exceeds the predetermined quantity.

13. The method of claim 8, wherein setting the game play aspect of the feature game comprises setting an average prize that is achievable in the feature game in proportion to the quantity of configurable symbols displayed at the plurality of display positions.

14. The method of claim 8, wherein setting the game play aspect of the feature game comprises setting a total prize that is achievable in the feature game in proportion to the quantity of configurable symbols displayed at the plurality of display positions.

15. The method of claim 8, further comprising increasing the credit balance per a jackpot value of a jackpot if the quantity of configurable symbols displayed at the plurality of display positions is at least as great as a threshold quantity associated with the jackpot.

16. A computer readable storage medium comprising instructions that, in response to being executed, cause a gaming machine to:

establish a credit balance in response to a credit input mechanism of the gaming machine receiving a physical item with an associated credit value;

initiate play of a base game in response to a first input received via a player interface of the gaming machine;

during play of the base game of the gaming machine, select and display a plurality of symbols at a plurality of display positions on a display device of the gaming machine; and after determining that a quantity of configurable symbols displayed at the plurality of display positions is greater than or equal to a predetermined quantity associated with triggering a feature game, triggering display of the feature game and setting a prize that is achievable during the feature game based, at least in part, on the quantity of configurable symbols displayed at the plurality of display positions; and during play of the feature game, select and display symbols for one or more of the plurality of display positions without configuration symbols while holding any configurable symbols at their respective display position on the display device;

increase the credit balance per configurable symbols displayed at the plurality of display positions; and cause a credit payout mechanism of the gaming machine to provide a payout from the credit balance in response to a second input received via the player interface of the gaming machine.

17. The computer readable storage medium of claim 16, wherein the instructions further cause the gaming machine to set a quantity of remaining games for the feature game to an initial quantity determined based, at least in part, on the quantity of configurable symbols displayed at the plurality of display positions.

18. The computer readable storage medium of claim 17, wherein the instructions further cause the gaming machine to at least:

decrease the quantity of remaining games after each game of the feature game; and increase the quantity of remaining games in response to at least one configurable symbol being selected as a replacement symbol.

19. The computer readable storage medium of claim 16, wherein the instructions further cause the gaming machine to at least set the prize that is achievable by setting an average prize that is achievable in the feature game in proportion to the quantity of configurable symbols displayed at the plurality of display positions.

20. The computer readable storage medium of claim 16, wherein the instructions further cause the gaming machine to at least set the prize by setting a total prize that is achievable in the feature game in proportion to the quantity of configurable symbols displayed at the plurality of display positions.

* * * * *